US006735809B2

(12) United States Patent
Parks

(10) Patent No.: US 6,735,809 B2
(45) Date of Patent: May 18, 2004

(54) MULTI-FACED HAND-HELD PAD

(75) Inventor: Robert T. Parks, Houston, TX (US)

(73) Assignee: XStreamline Products, Inc., Houston, TX (US)

( * ) Notice: Subject to any disclaimer, the term of this patent is extended or adjusted under 35 U.S.C. 154(b) by 0 days.

(21) Appl. No.: 10/141,734

(22) Filed: May 9, 2002

(65) Prior Publication Data

US 2003/0208866 A1 Nov. 13, 2003

(51) Int. Cl.[7] ..... A47L 13/12; A47L 13/16

(52) U.S. Cl. ..... 15/118; 15/209.1; 15/244.1; 15/244.4

(58) Field of Search ..... 15/244.1, 244.4, 15/118, 104.93, 229.11, 210.1, 209.1

(56) References Cited

U.S. PATENT DOCUMENTS

| | | | | |
|---|---|---|---|---|
| 1,388,282 | A | * | 8/1921 | Meredith |
| 1,935,485 | A | * | 11/1933 | Reynolds |
| 3,137,880 | A | * | 6/1964 | Kubit |
| 3,171,152 | A | | 3/1965 | Corcoran |
| 3,627,866 | A | * | 12/1971 | Laws |
| 3,648,319 | A | * | 3/1972 | Mitchell |
| 3,968,535 | A | | 7/1976 | Nichols, Jr. |
| 4,047,259 | A | | 9/1977 | Lotis |
| 4,196,490 | A | | 4/1980 | Jonzon |
| 4,287,633 | A | | 9/1981 | Gropper |
| 4,627,129 | A | | 12/1986 | Wittes |
| 4,672,707 | A | | 6/1987 | Johnson |
| D291,258 | S | | 8/1987 | Greer, Sr. |
| 4,893,370 | A | | 1/1990 | Klotz |
| 4,970,750 | A | | 11/1990 | Davis, III |
| 5,083,337 | A | | 1/1992 | Jones |
| 5,152,809 | A | | 10/1992 | Mattesky |
| D332,841 | S | | 1/1993 | Levison |
| 5,311,634 | A | | 5/1994 | Andros |
| 5,313,683 | A | | 5/1994 | Dickie et al. |
| D349,794 | S | | 8/1994 | Hayes, Jr. |
| D351,696 | S | | 10/1994 | Adolf |
| 5,351,356 | A | | 10/1994 | Townsend, Jr. |
| 5,408,718 | A | | 4/1995 | Sadovsky |
| 5,468,083 | A | * | 11/1995 | Chesar |
| 5,596,786 | A | | 1/1997 | Kluiters |
| D379,697 | S | | 6/1997 | Freudenberg et al. |
| D379,698 | S | | 6/1997 | Freudenberg et al. |
| 5,640,737 | A | | 6/1997 | Boggs |
| D392,433 | S | | 3/1998 | Norris |
| 5,791,008 | A | | 8/1998 | Crabtree |
| 5,836,034 | A | | 11/1998 | Galvan Garza |
| 5,915,869 | A | * | 6/1999 | Agosto |
| 6,216,307 | B1 | | 4/2001 | Kaleta et al. |

* cited by examiner

*Primary Examiner*—Randall Chin
(74) *Attorney, Agent, or Firm*—Wong, Cabello, Lutsch, Rutherford & Brucculeri, L.L.P.

(57) ABSTRACT

A hand-held pad is disclosed for cleaning, waxing, rubbing, polishing and applying liquid or semi-liquid to surfaces. The pad has at least four faces that are in non-parallel planes to every other face. Each face has a wide end tapered to a narrow end. Each face may have different texture, absorbency and/or abrasiveness than each other face. The hand-held pad provides ergonomic advantages and may be used on a variety of surfaces and/or materials.

7 Claims, 5 Drawing Sheets

MULTI-FACED HAND-HELD PAD

BACKGROUND OF THE INVENTION

1. Field of the Invention

The invention relates generally to the field of flexible hand-held pads for household and light commercial use, such as cleaning, waxing, rubbing, polishing and application of liquids and semi-liquids to surfaces.

2. Discussion of the Related Art

In the past, hand held pads including sponges typically have a rectangular or oblong shape, and are limited to two usable surfaces. The two surfaces will be referred to as the first face and second face. Sometimes, the first face is formed from a first component and the second face is formed from a second component, which are then affixed or adhered to each other. Alternatively, each face may be formed from a layer of material that covers a core component, or several layers of material that are laminated together.

The first face often may be formed and/or covered with a different material than the second face. The choice of material on each face depends on the desired characteristics such as texture, resiliency, absorbency and abrasiveness, to accomplish different functions for cleaning, waxing, rubbing, application of liquids and similar household and/or commercial applications.

Examples of hand-held pads include those shown in the following U.S. patents. U.S. Pat. No. 2,906,643 discloses a composite cellular structure made of a polyurethane foam layer chemically bonded to a layer of regenerated cellulose sponge. U.S. Pat. No. 3,377,643 discloses a similar pad structure. U.S. Pat. No. 2,804,728 discloses a sponge having one face with a mesh of an abrasive material partially embedded therein. U.S. Pat. No. 2,885,703 discloses a similar structure. U.S. Pat. No. 5,408,718 discloses a combination cleaning pad with two substantially parallel faces and an abrasive region that covers only part of one of the faces. U.S. Pat. No. 4,827,633 discloses a cleaning pad that fits tightly inside a sleeve or outer covering. U.S. Pat. No. 4,627,129 discloses a sponge having a flat washing face and a round back side with a notch for the user's finger to fit into.

However, the lateral surfaces between the faces of the hand-held pads described above are not particularly useful or functional for cleaning, waxing, rubbing, polishing, application of liquids or semi-liquids, or related work. One attempt to provide a pad with additional useful cleaning surfaces is U.S. Pat. No. 5,836,034, which discloses a sponge having one soft face, an opposing abrasive face, and projecting peaks around the peripheral sides. There also have been attempts to add useable surfaces in sponge mops in which a sponge or similar pad is attached to an elongated handle. For example, U.S. Pat. No. 5,351,356 discloses a sponge attached to a handle, the sponge having four flat side wiping surfaces, and a fifth surface at the end attached to the handle. U.S. Pat. Nos. 3,171,152 and 5,596,786 disclose sponge mops in which the sponge has a triangular cross section that can be rotated to permit use any of three surfaces.

A simple, economical, long-lasting hand-held pad is needed with additional faces that may be used for cleaning, waxing, rubbing, polishing, application of liquids or semi-liquids. Such a pad is needed for reaching corners and crevices. A pad also is needed that is easy to hold. Further, a pad is needed that may have different textures, absorbency, and abrasiveness on each face thereof.

SUMMARY OF THE INVENTION

The present invention is a simple, economical, long-lasting hand-held pad with at least four non-parallel usable faces for cleaning, waxing, rubbing, polishing or the application of liquids or semi-liquids. Each face is on a non-parallel, or intersecting, plane to each other face. Each face is tapered from a first, wide end to a second, narrow end. The second, narrow end of each face is dimensioned to facilitate reaching small items and narrow or sharp corners. Each face joins at least two adjacent faces. In one embodiment, each face may have a different texture, absorbency and abrasiveness than each other face.

The hand-held pad of the present invention has ergonomic advantages over prior art devices. The hand-held pad can be easily gripped on two or more of the non-parallel faces while another face is used for cleaning. The pad has sufficient thickness to facilitate manually gripping. The pad is flexible, although the seam between each face may provide increased stiffness.

The hand-held pad is economical to construct. The hand-held pad may be formed from one component, or several components that are adhered together. For example, each of the faces may be formed from a separate component, then adhered together. No central core is required.

Thus, an object of the invention is to produce a multi-faced hand-held pad that may be used to perform the function of washing, rubbing, waxing, polishing or applying liquids or semi-liquids to surfaces in a traditional fashion. It is another object of the invention to provide a multi-faced hand-held pad wherein each face has a different material with different abrasive and/or absorbent qualities. Another object of the invention is to provide a long lasting multi-faced hand-held pad with improved ergonomic design and improved effectiveness for reaching small or confined areas with difficult access. Another object of the invention is to provide a multi-faced hand-held pad that is economical to manufacture.

These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

BRIEF DESCRIPTION OF THE DRAWINGS

The drawings accompanying and forming part of this specification are included to depict certain aspects of the invention. A clearer conception of the invention, and of the components and operation of the invention, will become more readily apparent by referring to the exemplary, and therefore nonlimiting, embodiments illustrated in the drawings, wherein like reference numerals designate the same elements. The invention may be better understood by reference to one or more of these drawings in combination with the description presented herein. It should be noted that the features illustrated in the drawings are not necessarily drawn to scale.

DESCRIPTION OF PREFERRED EMBODIMENTS

The invention and the various features and advantageous details thereof are explained more fully with reference to the nonlimiting embodiments that are illustrated in the accompanying drawings and detailed in the following description. Descriptions of well known starting materials, processing techniques, components and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

The invention provides a multi-faced hand-held pad, with at least four non-parallel faces made from flexible and resilient material. Each face may be made from the same material or different materials on the outward surface thereof. The different materials may have distinct and different characteristics including permeability, density, consistency, absorbency, abrasiveness, and texture. The materials can include fabrics, nylon, plastics, elastomers, polymers, synthetic fibers, absorbent cellulose materials, metal or wire mesh, and others. Each face has a first end with a greater width than the second end thereof. Most preferably, as shown in the embodiment of FIG. 1, each face has a tapered or generally triangular shape.

The hand-held pad of the present invention may be formed from a single component, or assembled by adhering together two or more components using stitching, glue or similar flexible adhesive. Each component may be a laminated structure or a single, one-piece homogenous material. In the embodiment of FIG. 1, the first, wide end of each face abuts the first, wide end of another face to form a seam which has increased stiffness and resistance to compression. If several components with substantially uniform thickness are adhered together, the seams where the faces abut will have increased stiffness over the face because the components will be compressed at their seams.

The invention provides a multi-faced hand-held pad practicable for use in a variety of household and commercial environments. Although the hand-held pad is generally flexible, the seam at the first end of each face may have increased stiffness so as to provide a firm support when used. In a first preferred embodiment, as shown in FIGS. 1A and 1B, the multi-faced pad can be a four sided device, wherein the shape of each face is generally triangular.

Figure 1A:
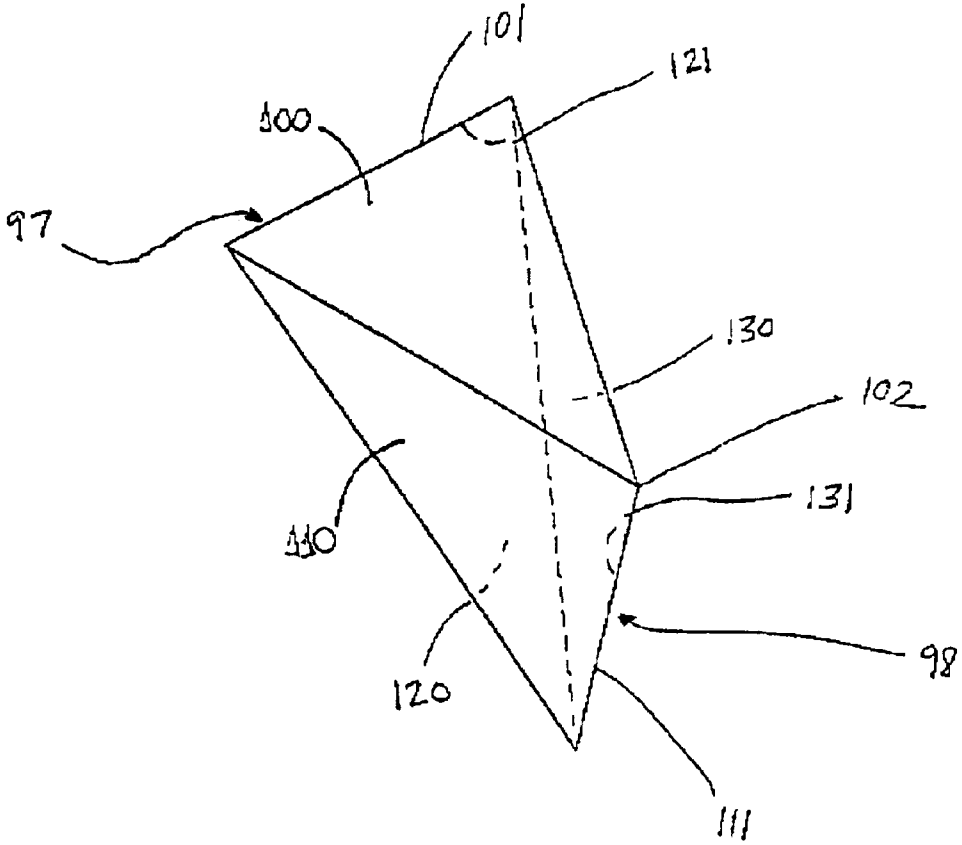
FIGS. 1A, 1B illustrate perspective views of a hand-held pad with four faces, representing a first preferred embodiment of the invention.
Figure 1B:
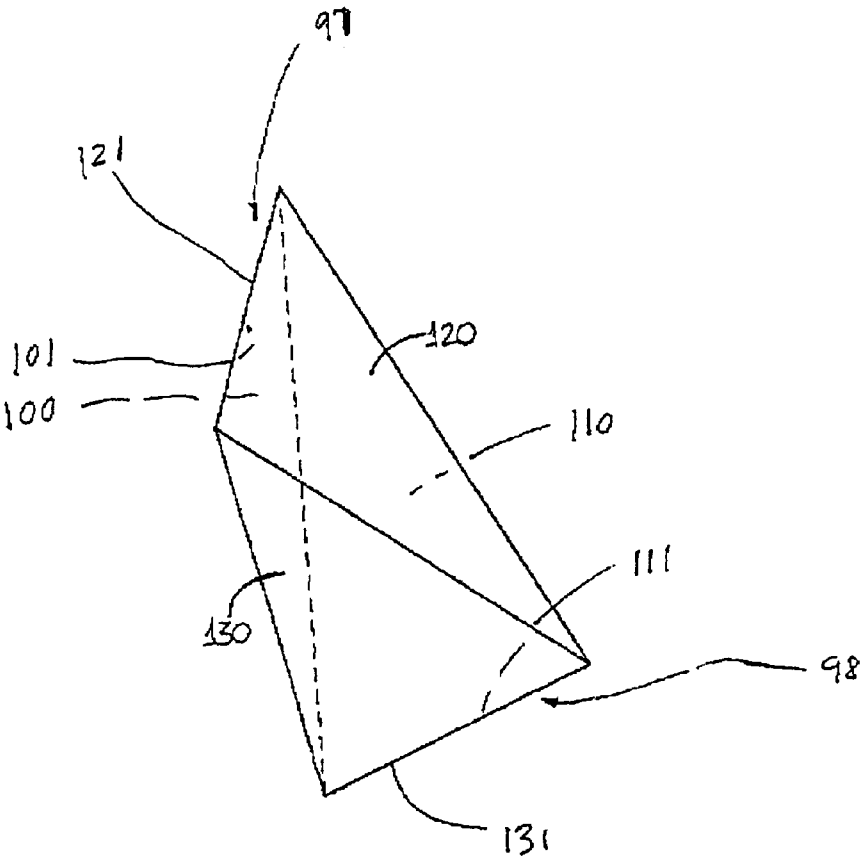

Referring to FIGS. 1A, 1B, perspective views of a multi-faced hand-held pad are depicted according to a first preferred embodiment thereof. The pad has four faces 100, 110, 120 and 130. These faces are coupled together so that first end 101 of face 100 abuts first end 121 of face 120 to form seam 97, and first end 111 of face 110 abuts first end 131 of face 130 to form seam 98. Face 100 is preferably tapered from first end 101 to second end 102. Most preferably, each face 100, 110, 120, 130 is generally triangular in shape. If two or more components are assembled together, the back of each component is affixed to the back of each other component using adhesive, although this also can be achieved by other means such as knitting, stitching, or sewing.

Figure 2:
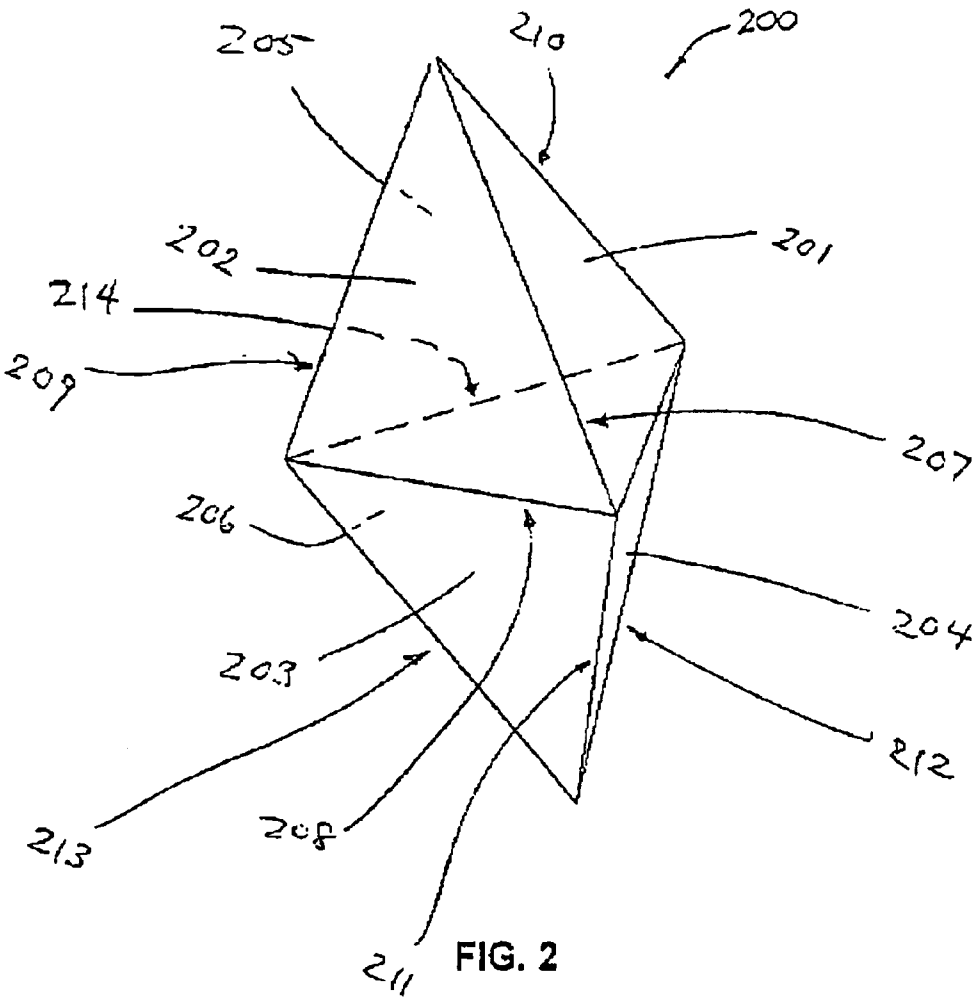
FIG. 2 illustrates a perspective view of a hand-held pad with six faces, representing a second preferred embodiment of the invention.

The first preferred embodiment shown in FIGS. 1A, 1B includes four non-parallel faces, but the invention can also provide a hand-held pad with more than four nonparallel faces that are practicably useful. Referring to FIG. 2, a perspective view of a six faced hand-held pad 200 according to a second preferred embodiment of the invention is depicted. Each face 201, 202, 203, 204, 205, 206 of pad 200 is in a non-parallel plane to each other face. Each face may be of the same or different material. If the six components are adhered together to make pad 200, seams 207, 208, 209, 210, 211, 212, 213, 214 can be made stiffer than the faces.

Figure 3:
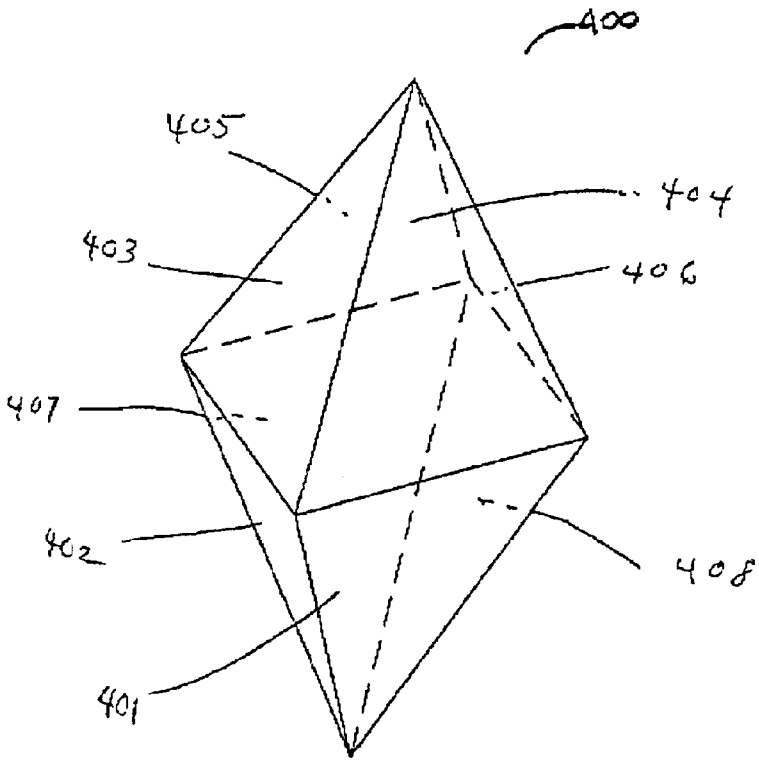
FIG. 3 illustrates a perspective view of a hand-held pad with eight faces, representing a third preferred embodiment of the invention.

Referring to FIG. 3, a perspective view of an eight sided hand-held pad 400 is depicted according to a third preferred embodiment. The eight sided pad 400 has non-parallel faces 401, 402, 403, 404, 405, 406, 407, 408 that are generally triangular in shape. Each face may be made with the same or different material.

Figure 4:
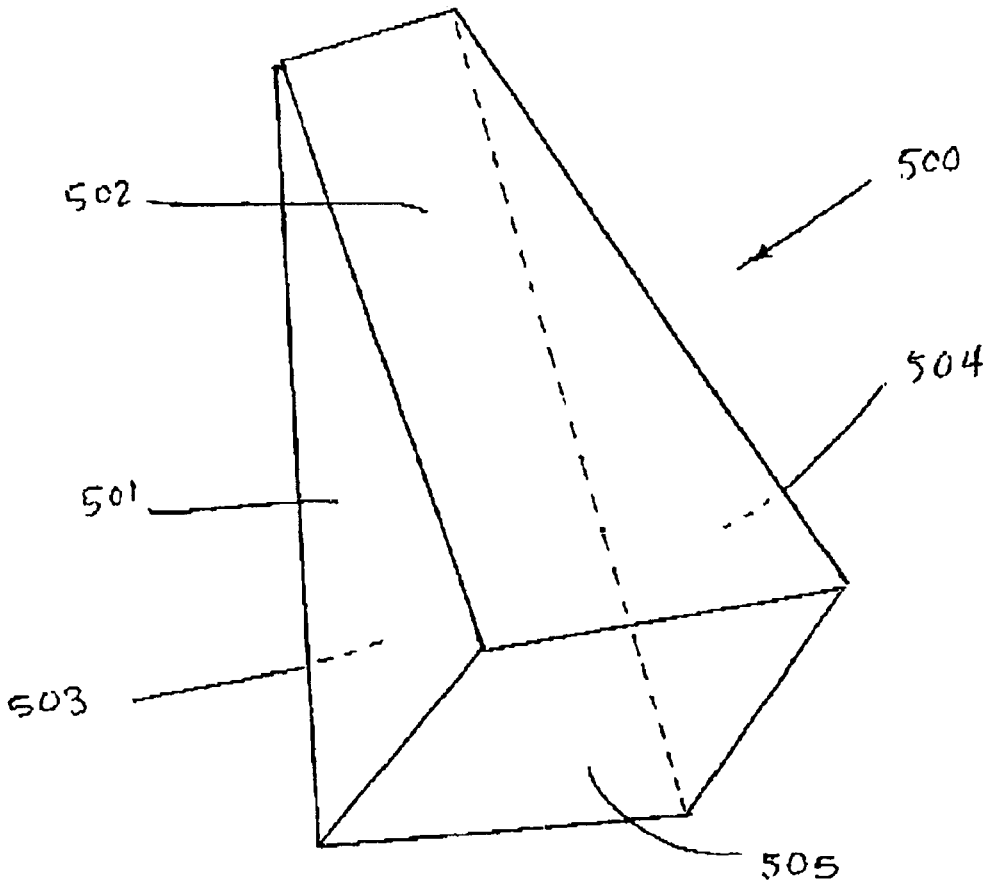
FIG. 4 illustrates a perspective view of a hand-held pad with five faces, representing a fourth preferred embodiment of the invention.

FIG. 4 illustrates a five sided hand-held pad 500 according to a fourth preferred embodiment. The five sided pad has non-parallel faces 501, 502, 503, 504, 505. Each face may be made with the same or different material.

A multi-faced hand-held pad for household or light commercial use, representing an embodiment of the invention, can be cost effective and advantageous for at least the following reasons. The invention reduces or eliminates unusable surfaces. The invention also provides an apparatus operable for cleaning, waxing, rubbing, polishing or applying liquid or semi-liquid to areas of difficult access, corners and the like. The invention improves quality and/or reduces costs compared to previous approaches.

It will be manifest that various substitutions, modifications, additions and/or rearrangements of the features of the invention may be made without deviating from the spirit and/or scope of the underlying inventive concept. It is deemed that the spirit and/or scope of the underlying inventive concept as defined by the appended claims and their equivalents cover all such substitutions, modifications, additions and/or rearrangements.

What is claimed is:

1. A hand-held pad comprising at least four faces made of resilient material, each face having a first, wide end of at least one other face, each of the faces being in a non-parallel plane to each of the other faces, wherein the first wide end of each face forms a seam where it abuts the first wide end of at least one other face, the seam having greater stiffness than the face.

2. The hand-held pad of claim 1 wherein each face has a different texture, abrasiveness, or absorbency than each other face.

3. The hand-held pad of claim 1 wherein the pad has four faces.

4. The hand-held pad of claim 1 wherein the pad has five faces.

5. The hand-held pad of claim 1 wherein the pad has six faces.

6. The hand-held pad of claim 1 wherein the pad has eight faces.

7. The hand-held pad of claim 1 wherein each face is generally triangular in shape.

* * * * *